US008867948B2

(12) United States Patent
Sato

(10) Patent No.: US 8,867,948 B2
(45) Date of Patent: Oct. 21, 2014

(54) CARTRIDGE CONFIGURATION FOR MAINTAINING CONTACT BETWEEN A TRANSFER ROLLER AND A DRUM

(75) Inventor: Fumikazu Sato, Konan (JP)

(73) Assignee: Brother Kogyo Kabushiki Kaisha, Nagoya-shi, Aichi-ken (JP)

( * ) Notice: Subject to any disclaimer, the term of this patent is extended or adjusted under 35 U.S.C. 154(b) by 254 days.

(21) Appl. No.: 13/433,932

(22) Filed: Mar. 29, 2012

(65) Prior Publication Data

US 2012/0321358 A1 Dec. 20, 2012

(30) Foreign Application Priority Data

May 31, 2011 (JP) ..... 2011-122018

(51) Int. Cl.
*G03G 15/00* (2006.01)
*G03G 21/18* (2006.01)

(52) U.S. Cl.
CPC ..... *G03G 21/1814* (2013.01)
USPC ..... 399/90

(58) Field of Classification Search
CPC ..... G03G 15/1645; G03G 15/1675; G03G 15/80; G03G 21/1867; G03G 21/1871; G03G 2215/1614
USPC ..... 399/90, 121, 313, 314
See application file for complete search history.

(56) References Cited

U.S. PATENT DOCUMENTS 6,064,841 A * 5/2000 Matsuzaki et al. ..... 399/90
8,588,641 B2 * 11/2013 Mimbu et al. ..... 399/90
2006/0269313 A1 11/2006 Takagi

FOREIGN PATENT DOCUMENTS

JP 5-39478 6/1993
JP 2006330620 A 12/2006

* cited by examiner

*Primary Examiner* — William J Royer
(74) *Attorney, Agent, or Firm* — Banner & Witcoff, Ltd.

(57) ABSTRACT

A cartridge may include a transfer roller, a photoconductor drum and a transfer electrode. In one or more examples, the transfer electrode may be disposed on a first side of the transfer roller while the photoconductor drum is disposed on a second side of the transfer roller, where the second side is opposite to the first side. The transfer electrode may further include ribs configured to aid in placement or positioning of the transfer electrode in one or more directions.

20 Claims, 7 Drawing Sheets

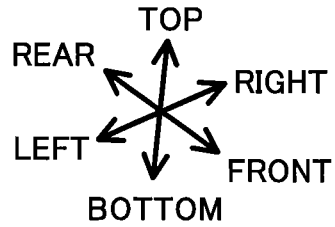
Fig.5A
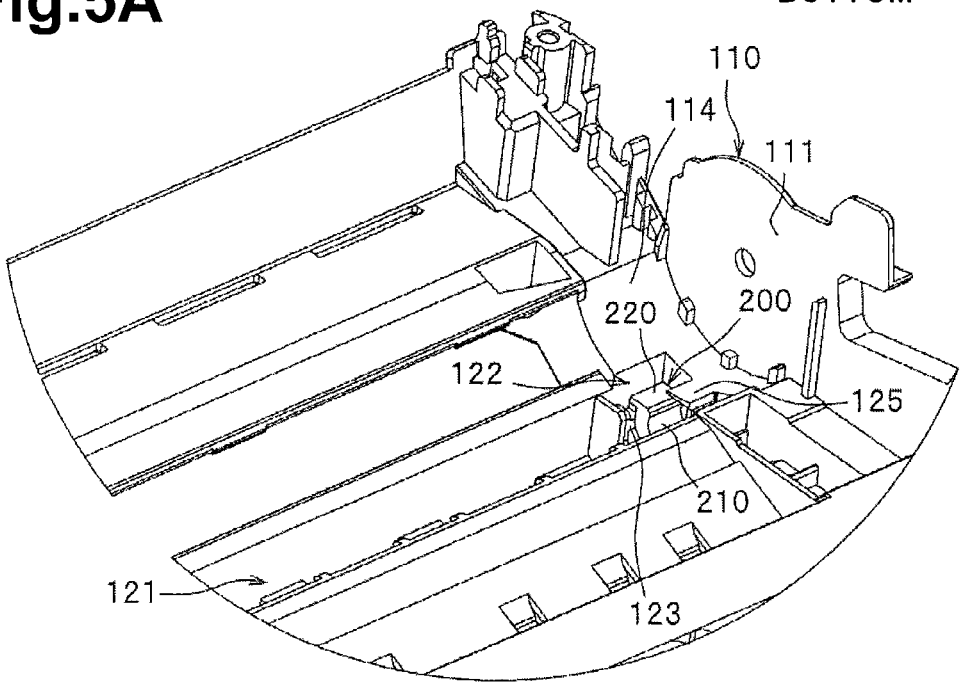
Fig.5B
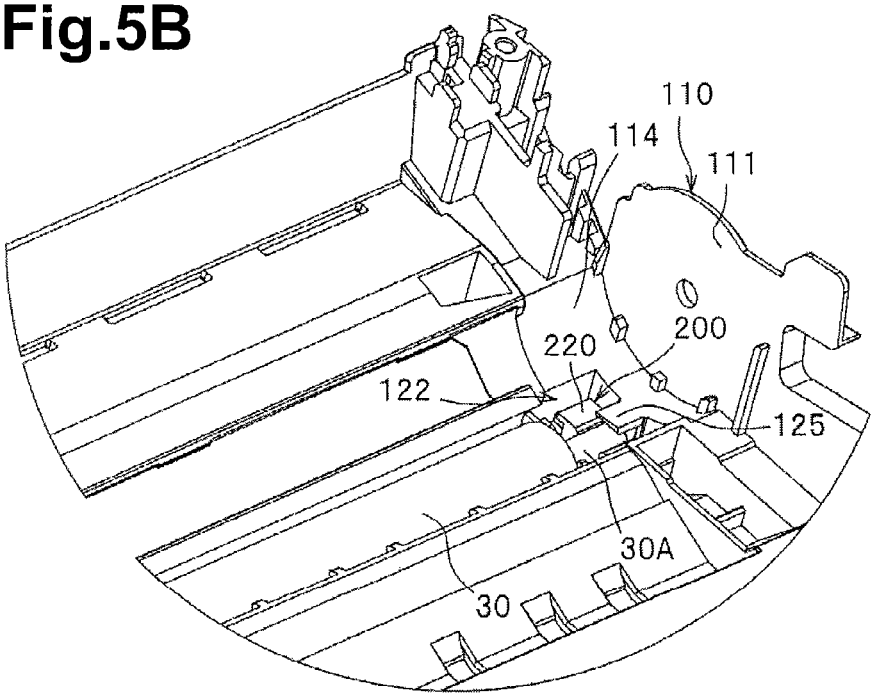

CARTRIDGE CONFIGURATION FOR MAINTAINING CONTACT BETWEEN A TRANSFER ROLLER AND A DRUM

CROSS-REFERENCE TO RELATED APPLICATION

This application claims the benefit of priority from Japanese Patent Application No. 2011-0122018, filed May 31, 2011. The contents of the above noted application is incorporated herein in its entirety.

TECHNICAL FIELD

Aspects described herein relate to cartridge configurations.

BACKGROUND

Cartridges for use in an electrophotographic image forming apparatus are known. Such cartridges may include a housing, a photoconductor drum, a transfer roller, and a transfer electrode for applying a voltage to the transfer roller. The photoconductor drum, the transfer roller and the transfer electrode may all be mounted in the housing (see, e.g., Japanese Unexamined Patent Application Publication No. 2006-330620). In particular examples, the transfer roller is disposed under the photoconductor drum and is arranged in opposing relation to the photoconductor drum in pressure contact. Further, the voltage is applied to the transfer roller through the transfer electrode, which is connected to a controller disposed inside an apparatus body and which is brought into contact with the end of a shaft of the transfer roller in a direction extending from the outer side toward the inner side in the axial direction of the transfer roller.

BRIEF SUMMARY

In the above-described systems and configurations, however, the pressure contact between the transfer roller and the photoconductor drum may become unstable because a force acts on the transfer roller from the transfer electrode in a direction perpendicular to the opposing direction in which the photoconductor drum and the transfer roller oppose each other.

Accordingly, aspects described herein provide a cartridge (e.g., a drum cartridge or process cartridge) configured to stably hold the transfer roller and the photoconductor drum in pressure contact with each other.

According to one or more aspects, a cartridge includes a housing, a photoconductor drum rotatably disposed in the housing, a transfer roller having a shaft and rotatably disposed in the housing in opposing relation to the photoconductor drum, and a transfer electrode for applying a voltage to the transfer roller.

Further, the transfer electrode may be held in contact with the shaft of the transfer roller at a side of the shaft opposite to a side at which the photoconductor drum is disposed.

Using such a configuration, the direction of a force acting on the transfer roller from the transfer electrode is substantially parallel to the opposing direction in which the photoconductor drum and the transfer roller oppose each other. Compared to the configuration of known devices in which the direction of the force acting on the transfer roller from the transfer electrode is perpendicular to the opposing direction in which the photoconductor drum and the transfer roller oppose each other, the transfer roller and the photoconductor drum according to configurations and aspects described herein can be stably held in contact with each other.

Further, in a cartridge configured according to aspects described herein, the transfer electrode may also be configured to act as a bearing for the shaft.

According to other aspects, the number of parts can be reduced in comparison with configurations in which the transfer electrode and the bearing for the transfer roller are provided separately from each other. Also, even when the size of the shaft or the housing is changed with, e.g., thermal expansion of the shaft or the housing, the transfer electrode can be reliably held in contact with the shaft.

Moreover, according to some aspects, the transfer electrode acting as the bearing for the shaft is arranged such that, when the transfer electrode is held in pressure contact with the shaft, a distance between the photoconductor drum and a portion of the transfer electrode nearest to the photoconductor drum in a pressing direction in which the transfer roller and the photoconductor drum are to be pressed, is equal to or greater than a distance between the photoconductor drum and a portion of the shaft nearest to the photoconductor drum in the pressing direction.

According to yet other aspects of the present disclosure, the transfer electrode can be disposed as far as possible away from the photoconductor drum, and hence a current can be inhibited from flowing (leaking) between the transfer electrode and the photoconductor drum.

According to further aspects, the housing has a cover portion arranged between the photoconductor drum and the transfer electrode. Accordingly, the current leak between the transfer electrode and the photoconductor drum can be reliably prevented.

Still further, in the above-described drum cartridge including the cover portion, as viewed in an perpendicular direction of the shaft, the cover portion is configured to extend in an axial direction of the shaft from an inner surface of the housing toward an interior of the housing and a distal end of the cover portion extends beyond an inner end of a portion of the photoconductor drum in which a bare pipe of the photoconductor drum is exposed.

According to the cartridge thus configured, the cover portion can be disposed only in a region where a current is apt to leak between the transfer electrode and the photoconductor drum, in a state not interfering with the pressure contact between the photoconductor drum and the transfer roller.

Still further, in the cartridge described above, the transfer electrode includes a first rib, which is formed on a surface of the transfer electrode on a side opposite to a surface of the transfer electrode held in contact with the shaft. The first rib is further configured to extend in an axial direction of the shaft, and to act as a contact connected to a power supply.

According to the cartridge thus configured, since the first rib of the transfer electrode is configured to act as the contact connected to the power supply, the transfer electrode can be reliably connected to the power supply even when the position of the transfer electrode is changed in the axial direction of the shaft with thermal expansion, for example.

According to other aspects, the transfer electrode may include a pair of second ribs formed on a surface of the transfer electrode on a side opposite to a surface of the transfer electrode held in contact with the shaft, and which extend in a circumferential direction of the shaft. Additionally or alternatively, the housing may include protrusions positioned between the pair of second ribs for positioning of the transfer electrode in the axial direction.

Accordingly, since the transfer electrode can be properly positioned by utilizing an inner width of the transfer electrode, the size of the transfer electrode can be increased compared to a configuration in which positioning members are disposed outside the transfer electrode.

BRIEF DESCRIPTION OF DRAWINGS

FIG. 5A is a perspective view illustrating an example housing and an example transfer electrode. FIG. 5B is a perspective view illustrating the housing, the transfer electrode, and an example transfer roller.

DETAILED DESCRIPTION

<Configuration of a Laser Printer>

An embodiment of the present disclosure will be described in detail below with reference to the drawings. In the following, the configuration of an example laser printer 1 (image forming apparatus) is first described, and other features of the present disclosure are then described.

Figure 1:
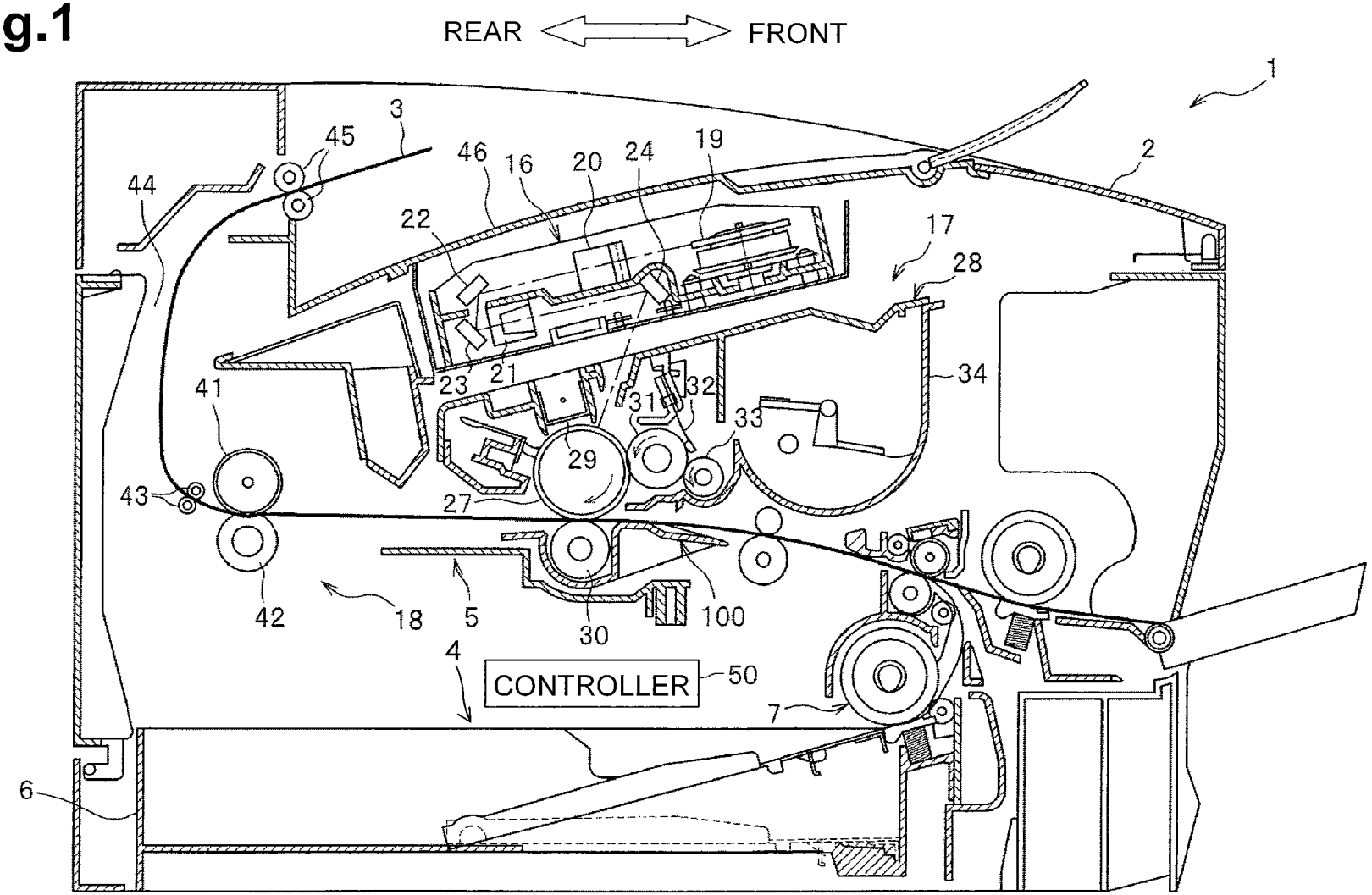
FIG. 1 is a schematic view illustrating an example configuration of a laser printer provided with a cartridge according to an embodiment.

As illustrated in FIG. 1, the laser printer 1 includes a feeder section 4 for supplying a sheet of paper 3, as one example of a recording sheet, into an apparatus body 2 and, an image forming section 5 for forming an image on the sheet of paper 3 supplied thereto.

It is to be noted that, in the following description, directions are defined on the basis of a user using the laser printer 1. In other words, it is defined that the "right side" in FIG. 1 represents the "front", the "left side" represents the "rear", the "front side" of the drawing sheet represents the "left", and the "back side" of the drawing sheet represents the "right". Further, the "up and down directions" in FIG. 1 represent "up and down", respectively.

The feeder section 4 includes a paper feed tray 6 removably mounted to a bottom portion within the apparatus body 2, and a paper feed mechanism 7 for conveying the sheet of paper 3 from the paper feed tray 6 to the image forming section 5. In the feeder section 4, the sheets of paper 3 in the paper feed tray 6 are separated one by one and fed to the image forming section 5 by the paper feed mechanism 7.

The image forming section 5 may include components such as a scanner unit 16, a process cartridge 17, a fusing device 18, a controller 50, and the like.

The scanner unit 16 is disposed in an upper portion within the apparatus body 2. A laser beam in accordance with image data is scanned at a high speed over the surface of a photoconductor drum 27 for irradiation after passing a polygon mirror 19, lenses 20 and 21 and, reflecting mirrors 22, 23 and 24 (see a one-dot-chain line).

The process cartridge 17 is configured to be removably mounted to the apparatus body 2. The process cartridge 17 includes a development cartridge 28 and a drum cartridge 100.

The development cartridge 28 is removably mounted to the apparatus body 2 in a state in which the development cartridge 28 is mounted to the drum cartridge 100. Alternatively, the development cartridge 28 may be configured to be removably mounted to the drum cartridge 100 that is fixed to the apparatus body 2. The development cartridge 28 includes a case body 34, a development roller 31, a layer-thickness restricting blade 32, and a supply roller 33. The case body 34 contains toner.

In the development cartridge 28, the toner in the case body 34 is supplied to the development roller 31 by the supply roller 33. At that time, the toner is frictionally charged to be positive between the supply roller 33 and the development roller 31. The toner supplied onto the development roller 31 is caused to enter between the layer-thickness restricting blade 32 and the development roller 31 with rotation of the development roller 31 such that the toner is held on the development roller 31 as a thin layer having a constant thickness while the toner is further frictionally charged.

The drum cartridge 100 includes the photoconductor drum 27, a scorotron type charger 29, and a transfer roller 30. In the drum cartridge 100, the surface of the photoconductor drum 27 is uniformly charged to be positive by the scorotron type charger 29, and the drum surface is then exposed to the laser beam, which is introduced from the scanner unit 16 and which is scanned at the high speed. As a result, a potential in the exposed area is reduced and an electrostatic latent image is formed in accordance with the image data.

Further, with the rotation of the development roller 31 in contact with the photoconductor drum 27, the toner charged to be positive and held on the surface of the development roller 31 is supplied to the electrostatic latent image that is formed on the surface of the photoconductor drum 27, whereby a toner image is formed on the surface of the photoconductor drum 27. Thereafter, when the sheet of paper 3 is conveyed to pass between the photoconductor drum 27 and the transfer roller 30, the toner image on the photoconductor drum 27 is attracted to the transfer roller 30 upon application of a voltage from the controller 50 through a transfer electrode 200 (described later). As a result, the toner image is transferred to the sheet of paper 3. The configuration of the drum cartridge 100 will be described in further detail below.

The fusing device 18 is disposed on the rear side of the process cartridge 17, and may include a heating roller 41 and a pressing roller 42 pressed against the heating roller 41. In the fusing device 18, the toner having been transferred onto the sheet of paper 3 is thermally fixed thereto while the sheet of paper 3 passes between the heating roller 41 and the pressing roller 42. The sheet of paper 3 to which the toner has been thermally fixed in the fusing device 18 is conveyed to a paper output path 44 by conveying rollers 43. Further, the sheet of paper 3 having been conveyed to the paper output path 44 is ejected onto a paper output tray 46 by paper output rollers 45.

The controller 50 is arranged at an appropriate position inside the apparatus body 2, and functions as a power source connected to the transfer electrode 200 (described later) through a body-side electrode 60. The body-side electrode 60 is supported by the apparatus body 2, thereby applying a transfer bias (voltage) to the transfer roller 30 (see FIG. 2).

<Cartridge Configuration>

The configuration of a cartridge such as the drum cartridge 100 will be described in further detail below.

Figure 2:
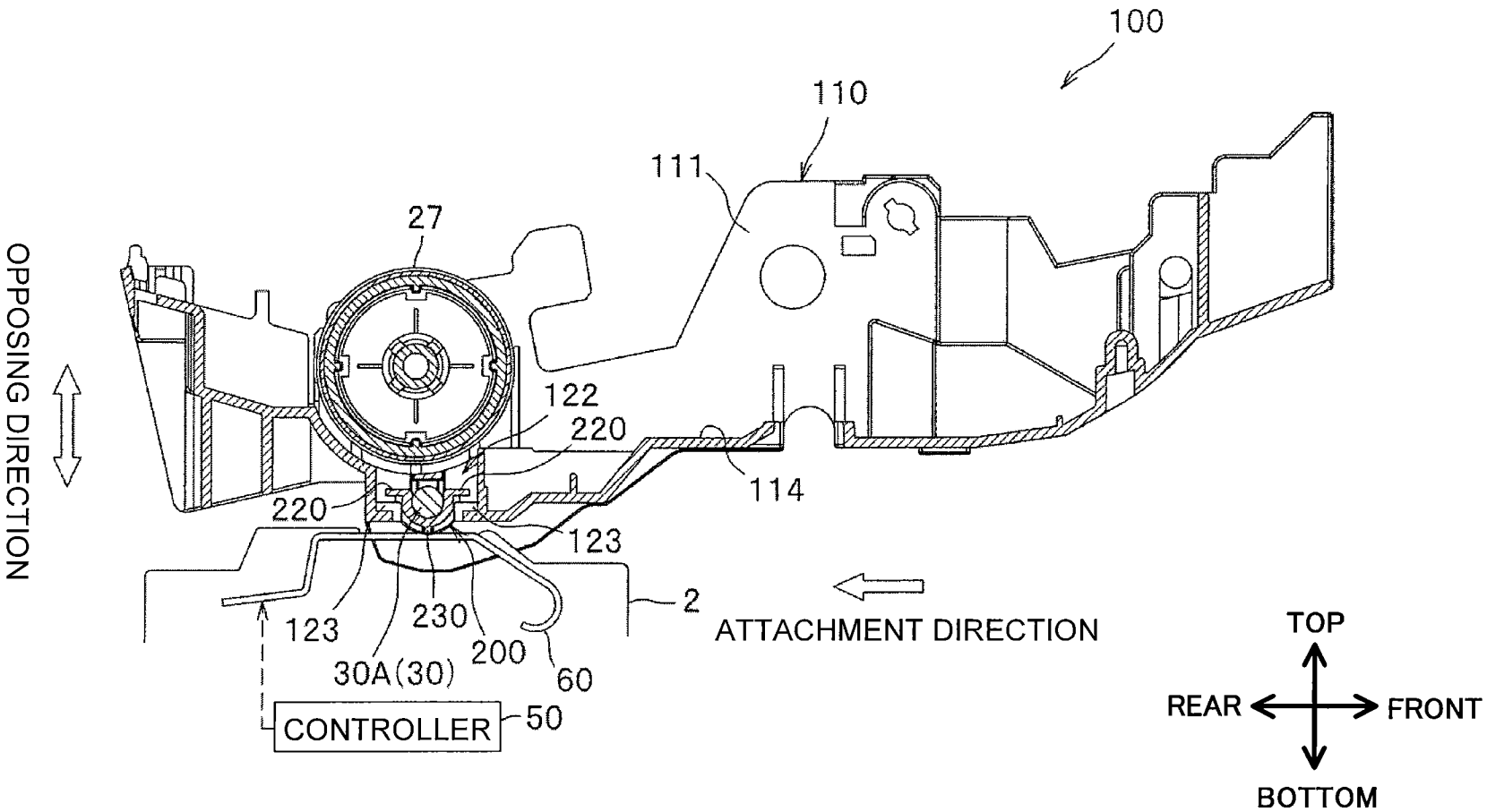
FIG. 2 illustrates an example state where a scorotron type charger of the cartridge according to the one embodiment is removed.

As illustrated in FIG. 2, the drum cartridge 100 includes, on the rear side of a housing 110, the photoconductor drum 27, the transfer roller 30 having a shaft 30A made of a metal, and the transfer electrode 200.

Figure 3A:
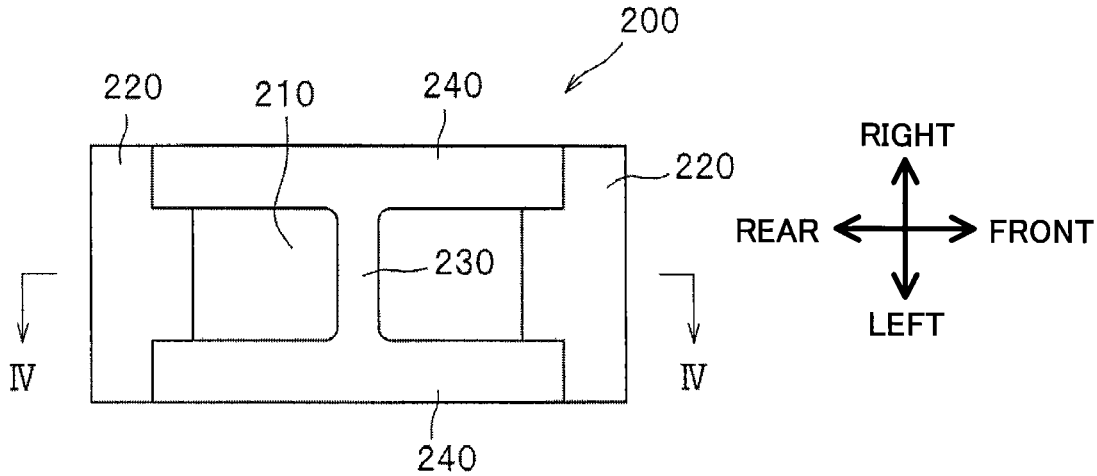
FIG. 3A is a bottom view of an example transfer electrode.
Figure 3B:
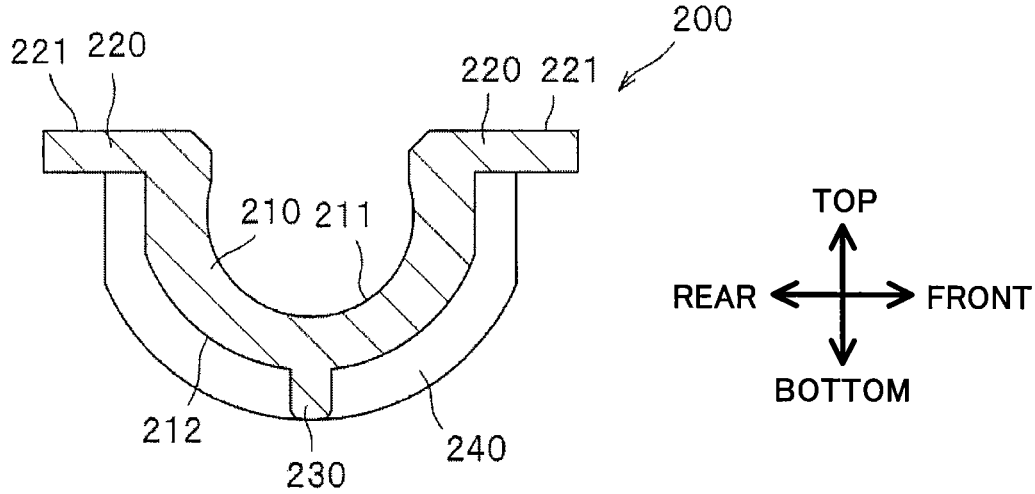
FIG. 3B is a sectional view taking along a line IV-IV in FIG. 3A.

The transfer electrode 200 is a member for applying the voltage to the transfer roller 30 and is made of, e.g., an electrically conductive resin. The transfer electrode 200 is also configured to function as a bearing for the shaft 30A of the transfer roller 30. As illustrated in FIGS. 3A and 3B, the transfer electrode 200 includes a bearing portion 210 having a substantially U-shape in a cross-sectional view, and a flange portion 220 extending outwards in the forward and rearward directions respectively from both the front and rear ends of the bearing portion 210.

The bearing portion 210 includes a first rib 230 and a pair of second ribs 240 on an outer peripheral surface 212 opposite to an inner peripheral surface 211 configured to contact the shaft 30A.

The first rib 230 serves as a contact that is connected to the controller 50 disposed inside the apparatus body 2. The first rib 230 is formed at the lowermost position of the bearing portion 210 so as to project downwards from the outer peripheral surface 212 and to extend in the axial direction of the shaft 30A (hereinafter referred to as the "axial direction").

The pair of second ribs 240 are formed to protrude from the outer peripheral surface 212. For example, a first rib of the pair of second ribs 240 protrudes from a first position and a second rib of the pair of second ribs 240 protrudes from a second position. In a particular example, the first and second ribs protrude from the left and right ends of the outer peripheral surface 212, respectively, and extend in the circumferential direction of the shaft 30A for connecting the front and rear flange portions 220 to each other.

Figure 4:
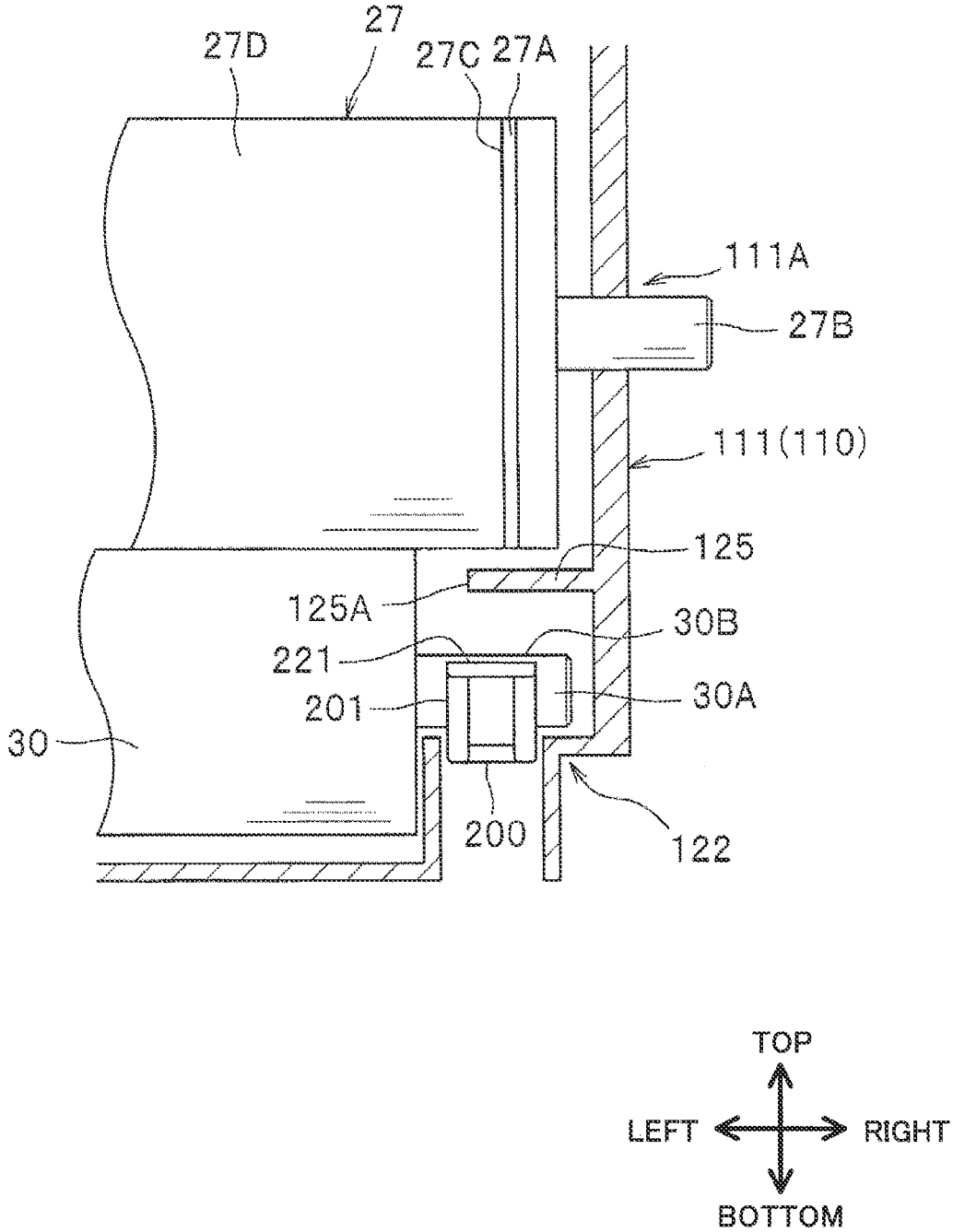
FIG. 4 is a schematic view illustrating an example configuration in the vicinity of respective right ends of a photoconductor drum and a transfer roller.

Further, as illustrated in FIG. 4, the size of the transfer electrode 200 in the up-and-down direction is set such that, when the transfer electrode 200 and the shaft 30A of the transfer roller 30 are in pressure contact with each other, an upper surface 221 of the flange portion 220 nearest to the photoconductor drum 27, is disposed farther away from the photoconductor drum 27 in the up-and-down direction than an upper end 30B of the shaft 30A nearest to the photoconductor drum 27. For example, when the transfer electrode 200 and the shaft 30A of the transfer roller 30 are in pressure contact with each other, an upper surface 221 of the flange portion 220, a distance between the photoconductor drum 27 and the upper surface 221 of the flange portion 220 in a pressing direction is greater than a distance between the photoconductor drum 27 and the upper end 30B of the shaft 30A.

The housing 110 has a hole 111A formed in each of left and right walls (only the right wall 111 being illustrated). A shaft 27B (described in further detail herein) of the photoconductor drum 27 is arranged in the hole 111A. Further, as illustrated in FIG. 5A, the housing 110 has, in its bottom wall 114, a transfer roller receiving portion 121 for receiving the transfer roller 30, and an electrode receiving portion 122.

The transfer roller receiving portion 121 is formed by partially recessing the bottom wall 114 downwards, and has a size capable of receiving a roller portion of the transfer roller 30. Moreover, a gear (not illustrated) rotatable with a driving force input from the outside is fixed to one end of the shaft 30A of the transfer roller 30. In the state where the housing 110 is assembled, as illustrated in FIG. 5B, the other end of the shaft 30A to which the gear is not fixed, is arranged on the right side, i.e., on the same side as the electrode receiving portion 122.

Returning to FIG. 5A, the electrode receiving portion 122 is disposed adjacent to a right side of the transfer roller receiving portion 121. In the electrode receiving portion 122, as illustrated in FIG. 2, the bottom wall 114 of the housing 110 is recessed downwards, and a recessed bottom portion is holed thoroughly in the up-and-down direction. Further, the electrode receiving portion 122 includes electrode supporting portions 123 for supporting the flange portions 220 of the transfer electrode 200, protrusions 128 (see FIGS. 6A and 6B) to be positioned between the pair of second ribs 240 of the transfer electrode 200, and a cover portion 125 (see FIGS. 5A and 5B.

In some examples, the electrode supporting portions 123 are formed in shapes of flat plates extending from both front and rear walls of the electrode receiving portion 122 inwards, respectively, in the rearward and forward directions.

Figure 6A:
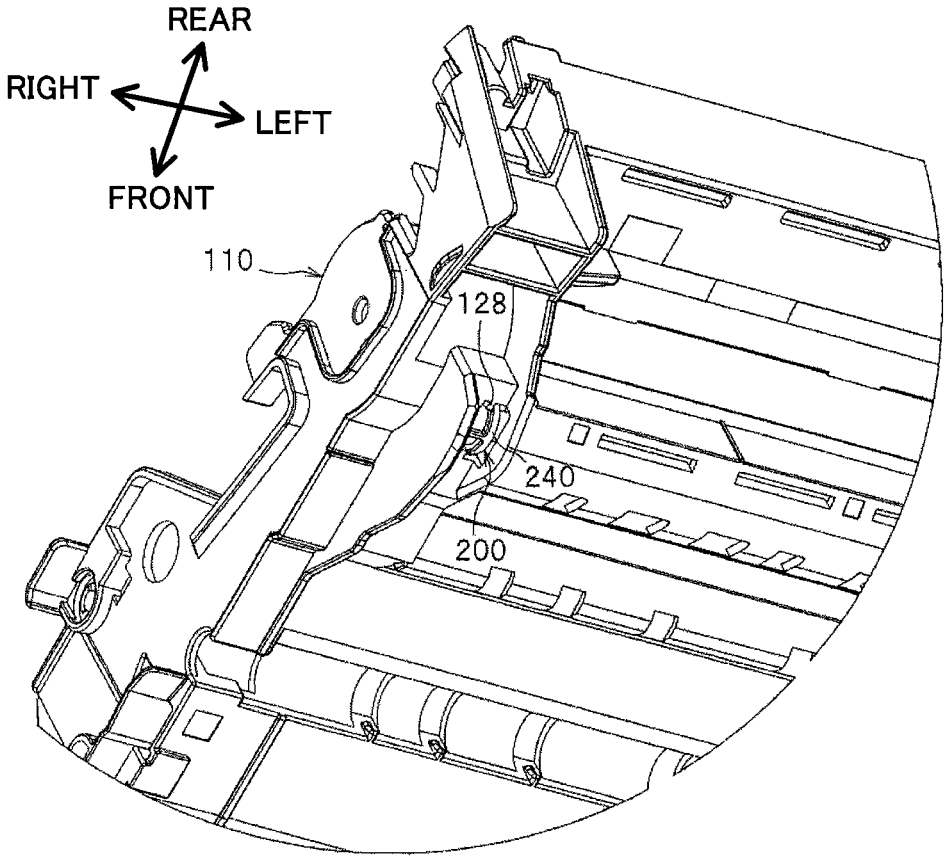
FIG. 6A is a perspective view of an example drum cartridge from below.
Figure 6B:
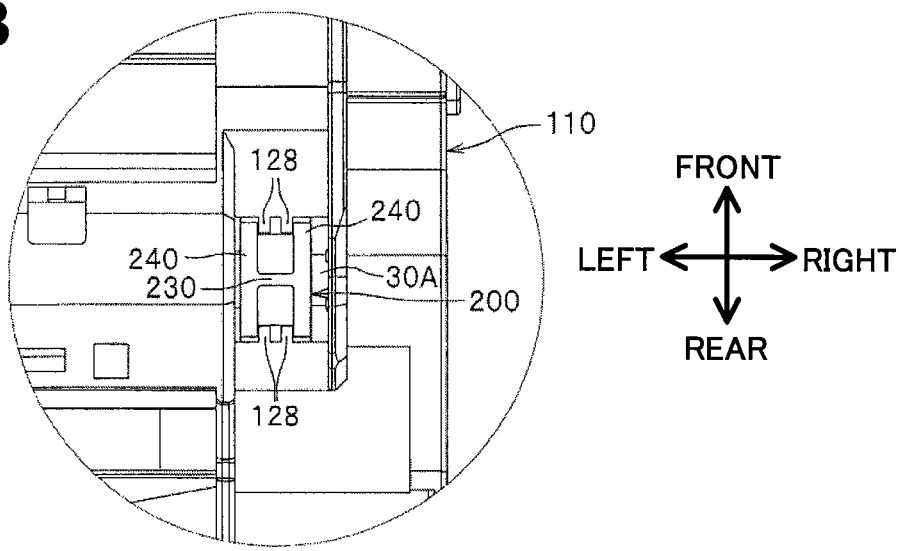
FIG. 6B is an enlarged bottom view illustrating the vicinity of the transfer electrode in the drum cartridge.

As illustrated in FIGS. 6A and 6B, the protrusions 128 include a first pair of protrusions and a second pair of protrusions. The first pair of protrusions are formed to protrude from a substantially central area of the front wall and the second pair of protrusions are formed to protrude from a substantially central area of the rear wall. The first and second pairs of protrusions 128 are configured to protrude inwardly, e.g., toward one another.

As illustrated in FIG. 5A, the cover portion 125 is formed to extend leftwards from the right wall 111 of the housing 110, e.g., to extend from the outer side toward the inner side in the axial direction of the shaft 30A of the transfer roller 30. Additionally, the cover portion 125 is arranged between the photoconductor drum 27 and the transfer electrode 200.

More specifically, as illustrated in FIG. 4, the photoconductor drum 27 is formed by coating a photoconductive layer 27D over the surface of a bare pipe 27A made of a metal, while portions of the bare pipe 27A are exposed at the left and right ends of the photoconductor drum 27. The photoconductor drum 27 is rotatably supported by the housing 110 with the shaft 27B arranged in the hole 111A of the housing 110, and is positioned in opposing relation to the transfer roller 30. Further, the transfer electrode 200 is arranged under a portion of the photoconductor drum 27 in which portion the bare pipe 27A is exposed. In one example, the cover portion 125 is disposed such that its distal end 125A is positioned leftward (inward) of an inner end 27C of the portion of the photoconductor drum 27 in which portion the bare pipe 27A is exposed, and rightward (outward) of an inner end 201 of the transfer electrode 200. In a particular example, the cover portion 125 is configured to extend in an axial direction of the shaft 30A from an inner surface of the housing 110 toward an interior of the housing 110 and the distal end 125A of the cover portion 125 extends beyond the inner end 27C of a portion 125 of the photoconductor drum 27 in which the bare pipe 27A of the photoconductor drum 27 is exposed.

In addition, as illustrated in FIGS. 6A and 6B, the transfer electrode 200 is arranged in the electrode receiving portion 122 such that adjacent protrusions 128 (e.g., positioned side by side in the left-and-right direction) are held between the pair of second ribs 240. Further, as illustrated in FIG. 5A, the flange portions 220 abut against the electrode 200 supporting portions 123, to restrict downward movement of the transfer electrode 200.

The operation and the advantageous effects of the drum cartridge 100, configured as described above, will be described below.

When the drum cartridge 100 is mounted to the apparatus body 2, the first rib 230 of the transfer electrode 200 comes into contact with the body-side electrode 60, thereby pushing the transfer electrode 200 upwards, as illustrated in FIG. 2. Thus, the transfer electrode 200 is pressed against a lower portion of the shaft 30A of the transfer roller 30, i.e., against a portion of the transfer roller 30 on an opposite side farther away from the photoconductor drum 27 in the up-and-down direction. The pressing of the transfer electrode 200 against the lower portion of the shaft 30A further causes the transfer roller 30 to be pushed towards the photoconductor drum 27 (e.g., by the transfer electrode 200). Accordingly, in contrast to the configuration of the related art in which the direction of the force acting on the transfer roller 30 from the transfer electrode 200 is perpendicular to an opposing direction in which the photoconductor drum 27 and the transfer roller 30 oppose each other, the direction of the force acting on the transfer roller 30 according to aspects described herein is substantially parallel to the opposing direction in which the photoconductor drum 27 and the transfer roller 30 are opposed to each other. As a result, the transfer roller 30 can be stably held in contact with the photoconductor drum 27.

Further, since the transfer electrode 200 serves also as a bearing for the shaft 30A, the number of parts can be reduced in comparison with a configuration where the transfer electrode 200 and the bearing for the shaft 30A are provided separately from each other. Additionally, even when the size of the shaft 30A or the housing 110 is changed with thermal expansion, for example, the transfer electrode 200 can be reliably held in contact with the shaft 30A of the transfer roller 30.

Moreover, since, when the transfer electrode 200 is in pressure contact with the shaft 30A, the upper surface 221 of the flange portion 220 of the transfer electrode 200 is disposed farther away from the photoconductor drum 27 than the upper end 30B of the shaft 30A. Accordingly, the transfer electrode 200 can be positioned as far as possible away from the photoconductor drum 27 so that a current can be inhibited from leaking between the transfer electrode 200 and the photoconductor drum 27.

Still further, since the housing 110 includes the cover portion 125 between the photoconductor drum 27 and the transfer electrode 200, a current can be reliably inhibited from leaking between the transfer electrode 200 and the photoconductor drum 27.

Still further, since the cover portion 125 is disposed such that, as viewed in the axial direction, the distal end 125A is positioned inward of the inner end 27C of the portion of the photoconductor drum 27 in which portion the bare pipe 27A is exposed, and outward of the inner end 201 of the transfer electrode 200, the cover portion 125 can be disposed only in a region where a current is likely to leak between the transfer electrode 200 and the photoconductor drum 27, and in a state not interfering with the pressure contact between the photoconductor drum 27 and the transfer roller 30.

Still further, since the transfer electrode 200 includes the first rib 230 extending in the axial direction and because the first rib 230 serves as the contact connected to the controller 50, the transfer electrode 200 can be reliably held in contact with the body-side electrode 60 even when the position of the transfer electrode 200 is changed in the axial direction with thermal expansion.

In addition, since the projections 128 disposed on the housing 110 are arranged between the pair of second ribs 240 extending in the circumferential direction of the transfer electrode 200, it is possible to properly position the transfer electrode 200 by utilizing the inner width of the transfer electrode 200.

Other features may also be used in conjunction with or alternatively to the features of the above described embodiments.

In one example, the embodiment described above includes an arrangement in which the upper surface 221 of the flange portion 220 of the transfer electrode 200 is positioned farther away (in an up-and-down direction) from the photoconductor drum 27 than the upper end 30B of the shaft 30A when the transfer electrode 200 is in pressure contact with the shaft 30A, the configurations described herein are not limited to such an arrangement. For example, the upper surface 221 of the flange portion 220 of the transfer electrode 200 may be disposed at the same position in the up-and-down direction as the upper end 30B of the shaft 30A when the transfer electrode 200 and the shaft 30A are in pressure contact with each other. That is, when the transfer electrode 200 and the shaft 30A of the transfer roller 30 are in pressure contact with each other, an upper surface 221 of the flange portion 220, a distance between the photoconductor drum 27 and the upper surface 221 of the flange portion 220 in a pressing direction is equal to a distance between the photoconductor drum 27 and the upper end 30B of the shaft 30A.

Also, while, in the embodiment described above, the distal end 125A of the cover portion 125 is positioned leftward of the inner end 27C of the portion of the photoconductor drum 27 in which portion of the bare pipe 27A is exposed, and rightward of the inner end 201 of the transfer electrode 200, the configuration of the cover portion 125 is not limited to such an arrangement. For example, the distal end 125A of the cover portion 125 may be located at the same position in the axial direction as the inner end 201 of the transfer electrode 200.

Figure 7A:
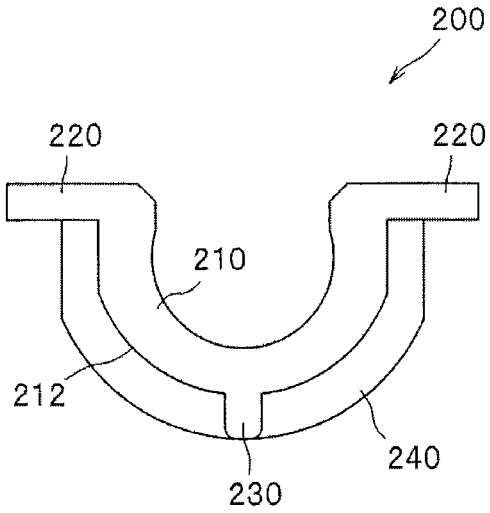
FIGS. 7A and 7B are a front view and a bottom view, respectively, of an example transfer electrode.
Figure 7B:
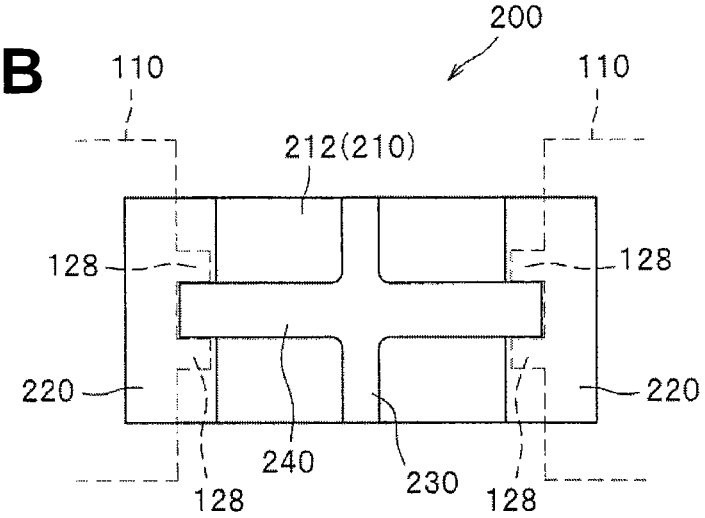

Further, while, in the embodiment described above, one pair of second ribs 240 are formed in the transfer electrode 200, the configuration of the transfer electrode 200 is not limited to such an arrangement. For example, as illustrated in FIGS. 7A and 7B, one second rib 240 may be formed in the transfer electrode 200. In a particular example, the second rib 240 is formed substantially in a central portion of the outer peripheral surface 212 of the transfer electrode 200 in the left-and-right direction. Further, every two projections 128 are formed to project, corresponding to each of substantially central areas of the transfer electrode 200 in the left-and-right direction, from the housing 110 in the rearward and forward directions, respectively, and the second rib 240 is sandwiched between every two projections 128. Using such an arrangement, it is possible to properly position the transfer electrode 200 in the axial direction.

Moreover, while, in the embodiment described above, one first rib 230 is formed in the transfer electrode 200, multiple first ribs may also be used. For example, two first ribs 230 may be disposed at positions that are spaced by the same distance from the central portion of the transfer electrode 200 in the forward-and-rearward direction.

While, in the embodiment described above, aspects relate to the laser printer 1, aspects described herein are not limited to such an application. For example, aspects of the present disclosure may be applied to other types of image forming apparatuses, e.g., a copying machine and a multifunction device.

According to aspects described in the present disclosure, the transfer electrode is held in contact with the shaft of the transfer roller on the opposite side farther away from the photoconductor drum in the opposing direction in which the photoconductor drum and the transfer roller are opposed to each other, the force exerted on the transfer roller acts only in the direction in which the transfer roller is opposed to the photoconductor drum. As a result, the pressure contact between the transfer roller and the photoconductor drum is stabilized.

The invention claimed is:

1. A cartridge comprising:

a housing;

a photoconductor drum configured to be rotatably disposed in the housing;

a transfer roller having a shaft and configured to be rotatably disposed in the housing in opposing relation to the photoconductor drum; and a transfer electrode configured to apply a voltage to the transfer roller, wherein the photoconductor drum is disposed at a first side of the transfer roller, wherein the transfer electrode is disposed at a second side of the transfer roller opposite to the first side, and wherein the transfer electrode is configured to be held in contact with the shaft of the transfer roller at the second side.

2. The cartridge according to claim 1, wherein the transfer electrode is also configured to act as a bearing for the shaft.

3. The cartridge according to claim 2, wherein, when the transfer electrode is held in pressure contact with the shaft, a distance between the photoconductor drum and a portion of the transfer electrode nearest to the photoconductor drum in a pressing direction in which the transfer roller and the photoconductor drum are to be pressed, is equal to or greater than a distance between the photoconductor drum and a portion of the shaft nearest to the photoconductor drum in the pressing direction.

4. The cartridge according to claim 1, wherein the housing includes a cover portion arranged between the photoconductor drum and the transfer electrode.

5. The cartridge according to claim 4, wherein the cover portion is configured to extend in an axial direction of the shaft from an inner surface of the housing toward an interior of the housing and a distal end of the cover portion extends beyond an inner end of a portion of the photoconductor drum in which a bare pipe of the photoconductor drum is exposed.

6. The cartridge according to claim 5, wherein the distal end of the cover portion is configured to extend does not extend beyond an inner end of the transfer electrode.

7. The cartridge according to claim 1, wherein the transfer electrode includes a first rib formed on a surface of the transfer electrode opposite to a surface of the transfer electrode held in contact with the shaft, wherein the first rib extends in an axial direction of the shaft, and is configured to act as a contact connected to a power supply.

8. The cartridge according to claim 1, wherein the transfer electrode includes a pair of second ribs formed on a first surface of the transfer electrode opposite to a second surface of the transfer electrode held in contact with the shaft, wherein the pair of second ribs extend in a circumferential direction of the shaft, and wherein the housing includes protrusions positioned between the pair of second ribs, wherein the protrusions are configured to position the transfer electrode in an axial direction of the shaft.

9. An image forming apparatus comprising:

a body comprising a body-side electrode; and a cartridge configured to be removably attached to the body, the cartridge comprising:

a housing;

a photoconductor drum configured to be rotatably disposed in the housing;

a transfer roller having a shaft and configured to be rotatably disposed in the housing in opposing relation to the photoconductor drum; and a transfer electrode configured to apply a voltage to the transfer roller from the body-side electrode, wherein the photoconductor drum is disposed at a first side of the transfer roller, wherein the transfer electrode is disposed at a second side of the transfer roller opposite to the first side, and wherein the transfer electrode is configured to be held in contact with the shaft of the transfer roller at the second side.

10. The image forming apparatus according to claim 9, wherein the transfer electrode also is configured to act as a bearing for the shaft.

11. The image forming apparatus according to claim 10, wherein, when the transfer electrode is held in pressure contact with the shaft, a distance between the photoconductor drum and a portion of the transfer electrode nearest to the photoconductor drum in a pressing direction in which the transfer roller and the photoconductor drum are to be pressed, is equal to or greater than a distance between the photoconductor drum and a portion of the shaft nearest to the photoconductor drum in the pressing direction.

12. The image forming apparatus according to claim 9, wherein the housing includes a cover portion arranged between the photoconductor drum and the transfer electrode.

13. The image forming apparatus according to claim 12, wherein the cover portion is configured to extend in an axial direction of the shaft from an inner surface of the housing toward an interior of the housing and a distal end of the cover portion extends beyond an inner end of a portion of the photoconductor drum in which a bare pipe of the photoconductor drum is exposed.

14. The image forming apparatus according to claim 13, wherein the distal end of the cover portion is configured to extend does not extend beyond an inner end of the transfer electrode.

15. The image forming apparatus according to claim 9, wherein the transfer electrode includes a first rib formed on a surface of the transfer electrode opposite to a surface of the transfer electrode held in contact with the shaft, wherein the first rib extends in an axial direction of the shaft, and is configured to act as a contact connected to a power supply.

16. The image forming apparatus according to claim 9, wherein the transfer electrode includes a pair of second ribs formed on a first surface of the transfer electrode opposite to a second surface of the transfer electrode held in contact with the shaft, wherein the pair of second ribs extend in a circumferential direction of the shaft, and wherein the housing includes protrusions positioned between the pair of second ribs, wherein the protrusions are configured to position the transfer electrode in the an axial direction of the shaft.

17. A cartridge comprising:

a housing;

a photoconductor drum configured to be rotatably disposed in the housing;

a transfer roller having a shaft and configured to be rotatably disposed in the housing in opposing relation to the photoconductor drum; and a transfer electrode configured to apply a voltage to the transfer roller, wherein at least a portion of the transfer roller is disposed between the transfer electrode and the photoconductor drum in a pressing direction in which the transfer roller is configured to be pressed against the photoconductor drum, and wherein the transfer electrode is configured to be held in contact with the shaft of the transfer roller.

18. The cartridge according to claim 17, wherein the housing includes a cover portion arranged between the photoconductor drum and the transfer electrode.

19. The cartridge according to claim 18, wherein the cover portion is configured to extend in an axial direction of the shaft from an inner surface of the housing toward an interior of the housing and a distal end of the cover portion extends beyond an inner end of a portion of the photoconductor drum in which a bare pipe of the photoconductor drum is exposed.

20. The cartridge according to claim 17, wherein, when the transfer electrode is held in pressure contact with the shaft, a distance between the photoconductor drum and a portion of the transfer electrode nearest to the photoconductor drum in the pressing direction is equal to or greater than a distance between the photoconductor drum and a portion of the shaft nearest to the photoconductor drum in the pressing direction.

* * * * *